United States Patent [19]

Muller

[11] 4,428,777

[45] Jan. 31, 1984

[54] PROCESS FOR CLEANING TRANSPORT ROLLS OF FILM DEVELOPING APPARATUS

[75] Inventor: Mathias Muller, Oberstenfeld, Fed. Rep. of Germany

[73] Assignee: Durr-Dental GmbH & Co. KG, Bietigheim, Fed. Rep. of Germany

[21] Appl. No.: 357,579

[22] Filed: Mar. 15, 1982

[30] Foreign Application Priority Data

Mar. 14, 1981 [DE] Fed. Rep. of Germany ..... 3109935

[51] Int. Cl.[3] ..... B08B 8/00

[52] U.S. Cl. ..... 134/6; 134/32; 134/33; 134/64 P; 134/73; 354/321; 354/322

[58] Field of Search ..... 354/320, 321, 322; 134/4, 6, 7, 32, 33, 64 P, 73

[56] References Cited

U.S. PATENT DOCUMENTS

| | | | |
|---|---|---|---|
| 2,968,577 | 1/1961 | Helling et al. | 134/6 X |
| 3,862,801 | 1/1975 | Komp | 134/6 X |
| 4,232,691 | 11/1980 | Grant | 354/322 X |
| 4,291,969 | 9/1981 | Raymond | 354/322 |

*Primary Examiner*—Robert L. Lindsay, Jr.

*Attorney, Agent, or Firm*—Robert E. Burns; Emmanuel J. Lobato; Bruce L. Adams

[57] ABSTRACT

A process of cleaning the film transport rolls of developing apparatus having a transport system comprising a plurality of pairs of rolls for transporting the film from an inlet through successive aqueous baths and a drying section and out of a discharge, some of the rolls being above and others below the liquid level in the baths comprises passing lengthwise through the transport system of the apparatus a rectangular sheet of fleece material having fibers oriented parallel to one another and to the longitudinal edges of the sheet. The fibers are made of a material which is substantially free of swelling by the action of the baths of the developing apparatus. However, the liquid of the baths is absorbed in the interstices between the fibers of the fleece material so that as the cleaning material passes along the transport system it moistens those rolls which are above the liquid level and may have dried out. Any soluble impurities on such rolls are thereby dissolved. Any insoluble impurities on rolls above or below the liquid level are passed into the interstices between the fibers of the fleece material and are carried away by the material.

8 Claims, No Drawings

PROCESS FOR CLEANING TRANSPORT ROLLS OF FILM DEVELOPING APPARATUS

FIELD OF INVENTION

The invention relates to a process for cleaning the film transport rolls of apparatus for developing and processing film and other photosensitive material, such apparatus having a transport system comprising a series of rolls for transporting the film or other photosensitive material from an inlet through successive baths such as a developing bath, a fixing bath and a washing bath and ultimately through a drying section and out of a discharge for the processed film. The invention further relates to a special sheet material which is used in carrying out the process by passing a rectangular sheet of such material through the transport system of the apparatus, such as that shown in U.S. Pat. No. 4,086,607.

BACKGROUND OF THE INVENTION

Such developing apparatus is used for example in medical, dental and graphic arts. In the medical and dental fields, apparatus is required for developing photosensitive material and in particular X-ray film. In the graphic arts it is usually light sensitive film or light sensitive paper that is to be developed.

In these fields of use it is important for the photosensitive material to pass through the developing apparatus without defects being produced by the developing apparatus in the optical information on the photosensitive material. Such defects can easily occur especially when dirt from the transport system of the apparatus is transferred to the photosensitive material. The transport system of such apparatus usually comprises pairs of rollers between which the sheet-form photosensitive material passes. Of such pairs of rollers usually about 40 percent are located above the liquid level in the apparatus while the remaining 60 percent are below the liquid level. Crystallized chemical residues, gelatin, silver, lime and other impurities from the water are deposited on the rollers. This occurs especially on the upper rollers when the machine is switched off and these rollers become dry.

On the morning when the developing apparatus is started up these dirt particles are picked up by the first photosensitive material being processed and thereby produce, for example on an X-ray film, patterns which are actually not present. Especially in the medical and dental fields such misinformation is not acceptable.

In order to avoid such defects it has been proposed to pass one or two cleaning films through the apparatus when it is first started up after standing idle for a long time. In this manner the roller pairs are cleaned by the relatively thin emulsion layer of the film. Such cleaning films can ordinarily be used only since the emulsion on the surface is so hardened by the fixing bath and the drying that if the film is used again the desired cleaning of the rollers is not effected.

Such previously used cleaning films are relatively expensive as these are for example films having a relatively high silver content. There are also on the market plastic films for use in cleaning the rolls of developing apparatus instead of the silver-containing cleaning film. However, the cleaning effected by such plastic films has not been found to be satisfactory.

SUMMARY OF THE INVENTION

An object of the present invention is to provide a cleaning film which is comparable in effectiveness and handling with conventional silver-containing film but which is made of other material without silver.

In accordance with the invention the cleaning film comprises fleece material of which the fibers are essentially free of swelling under the action of aqueous solutions but the interstices between the fibers absorb an aqueous solution with the preferred fiber direction parallel to the long side of a rectangular sheet.

Fleece material was invented about 1920 but did not come on the market until about 1940. Today fleece material is used in a thousand different applications. For example it is known to use fleece material as household cleaning cloths. It may hence appear astonishing that fleece material has not heretofore been used for cleaning the transport rolls of film developing apparatus especially since an effort has been made for more than 10 years to limit the use of silver film and hence for example numerous copying processes have been conceived which permit the production of multiple copies without the use of silver-containing film. It has, however, been found that for cleaning film for the above-mentioned purpose, only fleece material with specially selected characteristics is suitable. Although for example plastic material which satisfies the required material conditions have been known for a decade and although as stated above the need of limiting the use of silver-containing film has existed for more than a decade, there was no conception of the particular characteristics required for satisfactorily using fleece material for cleaning the transport rolls of film developing apparatus.

Fleece material is known with oriented fibers and also with unoriented fibers. For the present use the fleece material must have predominantly aligned fibers. Moreover, the preferred direction of the fibers of the fleece material must be aligned parallel to the direction in which the material is transported through the developing apparatus. In order for this required running direction to be clearly indicated, the sheet of material is cut rectangular with the preferred fiber direction parallel to the long sides.

The transport of the cleaning material in a direction parallel to the oriented fibers has important advantages. In the first place this assures that the sheet runs through the entire developing apparatus without distortion and without running obliquely. Secondly, the sheet of fleece material is substantially more resistant to bending in the fiber-oriented direction than crosswise thereto and also more resistant to bending than a fleece material with wholly unoriented fibers. A certain resistance to bending of the sheet is, however, necessary so that it does not wrap around the transport rolls. When the predominant fiber direction is selected as the running direction, a certain stiffness of the sheet is obtained with a substantially less weight of the sheet than when the fiber is oriented otherwise or is unoriented.

A limited weight of the sheet means not only a saving of material with respect to the use of a heavier sheet but also operation of the sheet substantially without carrying over a particular aqueous solution, for example the developing solution, into another aqueous solution, for example the fixing solution, in developing apparatus. The lower the weight of the sheet and hence the lower the total volume of the interstices between the fibers, the less liquid is transported by the sheet from one aqueous solution to the next.

In order further to reduce the carry over of one kind of aqueous solution to another it is further provided that the fibers are essentially free of swelling under the action of aqueous solutions. The fleece material must, however, absorb the aqueous solution in the interstices between the fiber. This last condition is satisfied by many fleece materials such as hydrophobic materials while the condition of freedom from swelling considerably restricts the number of usable fleece materials.

Plastic materials come predominantly into question but also other materials, for example of a glass fiber base or glass fiber reinforced plastic fleece materials, are known and usable. An especially advantageous price is attained when thermoplastic material is used for the fleece material as with such materials the individual fibers can be simply and economically fused to one another. Among the thermoplastic materials, for example, the polyolefine group satisfy the conditions of freedom of swelling of the fibers. The individual materials of this group as for example polypropylene, polyethylene, polybutene or polyisobutylene are technically employed in a wide range and are hence likewise easily and economically produced as fleece material. Especially recommended is the use of polypropylene as polypropylene fibers have an especially high stiffness which leads to the fact that for the reasons mentioned above a foil of low weight can be used. This likewise leads to the other advantages referred to above. The preferred weight of polypropylene fleece material lies between 20 and 70 grams per square meter. However, a foil of 40 grams per square meter is also usable as this is sufficiently stiff that it will not wrap around the film transport rolls. Foils with a weight of 100 grams per square meter will run satisfactorily through the developing apparatus but then the carry over of chemicals from one bath of water solution to another is unnecessarily high.

Through the aqueous solution which is absorbed in the interstices between the fibers of the fleece material, the dried-out film transport rolls are moistened whereby crystallized chemical residues are dissolved and carried off by the cleaning material. Insoluble impurities such for example as silver and lime on the transport rolls above and below the liquid level are pressed into the interstices between the fibers as the material runs between a pair of rollers whereby they are freed from the rollers and carried off by the cleaning material.

The cleaning effect for such solid impurities can, however, be improved by coating the plastic fibers of the fleece material with an adhesive. As an adhesive, almost any water insoluble pressure sensitive adhesive on the market can be used. In this case it is especially advantageous for the material of the fleece material and the adhesive to be matched to one another thus for example for a polyisobutylene fleece material an adhesive on a polyisobutylene base can be used. The fleece material can also be produced from nonadhesive fibers and then coated with a pressure sensitive adhesive after its production. In this case care must be taken that the interstices between the fibers are not filled with the adhesive. Instead of the fleece material being coated with a layer of adhesive, the fibers of the fleece material can be made of an adhesive material whereby the adhesive can also bond the individual fibers together.

Fleece material in accordance with the present invention is conveniently and economically made in the form of a continuous web which is then cut into rectangular sheets of suitable size. In making the fleece material with fibers of thermoplastic material, a thin layer of the fibers is laid with the fibers unoriented so that fibers cross one another while the greater part of the fibers are oriented in the preferred direction e.g. lengthwise of the web. The material is thereupon rolled and pressed between heated cylinders whereby the unoriented fibers are welded together at their crossing points to bond the fibers together. Instead of being formed of thermoplastic material, the fibers can be coated with a thermoplastic or adhesive material for bonding the fibers together. The non-woven fleece material thus produced is porous, with a multiplicity of interstices between the fibers. In a preferred embodiment the thickness of the fleece material is 0.1 to 0.2 mm.

What we claim is:

1. A process of cleaning the film transport rolls of developing apparatus having a transport system comprising a plurality of pairs of rolls for transporting the film from an inlet, through successive aqueous baths and a drying section and out of a discharge, some of said rolls being above and others below the liquid level in said baths, which process comprises passing alone through said transport system of said apparatus a rectangular sheet of fleece material having fibers predominantly oriented parallel to one another and to the longitudinal edges of said sheet, said fibers being substantially free of swelling by action of said baths, and interstices between said fibers absorbing liquid of said baths, said sheet being transported lengthwise by said rolls from said inlet to an out of said discharge, whereby any soluble impurities on said rolls above said liquid level are dissolved and carried away by said material and any insoluble impurities on rolls above or below said liquid level are pressed into said interstices and carried away by said material.

2. A process according to claim 1, in which said fleece material comprises fibers of plastic material.

3. A process according to claim 2, in which said plastic material is thermoplastic, said fibers being welded together at crossing points.

4. A process according to claim 3, in which the thermoplastic material is a polyolefin.

5. A process according to claim 4, in which the thermoplastic material is polypropylene.

6. A process according to any one of claims 2 to 5, in which the weight of said fleece material is between 40 and 100 $g/m^2$.

7. A process according to claim 1, in which fibers of said fleece material are adhesive to bond individual fibers together.

8. A process according to claim 1, in which said fleece material has a thickness of about 0.1 to 0.2 mm.

* * * * *